US006286628B1

(12) United States Patent
Lee

(10) Patent No.: US 6,286,628 B1
(45) Date of Patent: Sep. 11, 2001

(54) NON-LINEAR LOAD DETECTION AND COMPENSATION FOR ELEVATORS

(75) Inventor: Soo-Cheol Lee, Changwon (KR)

(73) Assignee: LG Otis Elevator Company, Seoul (KR)

( * ) Notice: Subject to any disclaimer, the term of this patent is extended or adjusted under 35 U.S.C. 154(b) by 0 days.

(21) Appl. No.: 09/492,786

(22) Filed: Jan. 28, 2000

(30) Foreign Application Priority Data

Jan. 28, 1999 (KR) ..... 2924/1999

(51) Int. Cl.[7] ..... B66B 3/00
(52) U.S. Cl. ..... 187/393
(58) Field of Search ..... 187/391–394, 187/292, 290, 281, 411; 177/132

(56) References Cited

U.S. PATENT DOCUMENTS

| | | | | |
|---|---|---|---|---|
| 3,543,883 | * | 12/1970 | Kuzara | 187/29 |
| 4,330,836 | * | 5/1982 | Donofrio et al. | 187/29 R |
| 4,951,786 | * | 8/1990 | Haraguchi | 187/1 R |
| 5,004,076 | * | 4/1991 | Chen et al. | 187/130 |
| 5,343,003 | * | 8/1994 | Jamieson et al. | 187/131 |
| 5,402,861 | * | 4/1995 | Kohara | 187/292 |
| 5,421,433 | * | 6/1995 | Yoo | 187/391 |
| 5,435,416 | * | 7/1995 | Siikonen et al. | 187/392 |
| 5,862,888 | * | 1/1999 | Iwakiri et al. | 187/292 |
| 5,894,910 | * | 4/1999 | Suur-Askola et al. | 187/290 |
| 6,000,505 | * | 12/1999 | Allen | 187/391 |
| 6,021,873 | * | 2/2000 | Aulanko et al. | 187/411 |

FOREIGN PATENT DOCUMENTS

| | | | | |
|---|---|---|---|---|
| 528188-A1 | * | 2/1993 | (EP) | 187/392 |
| 2690430-A1 | * | 10/1993 | (EP) | 187/392 |

* cited by examiner

*Primary Examiner*—Jonathan Salata

(57) ABSTRACT

An apparatus and a method for detecting a load amount of an elevator which detects the weight of the passengers of an elevator car in an elevator system including the steps of: setting an output data of a load detector for at least two load amounts between an no-load and full load; obtaining a non-linear relational function expression between the output data of the load detector and the load amounts on the basis of the set data; selecting one of the at least two functional expressions on the basis of the relational function expressions, and detecting and outputting a load amount for the passengers of the elevator car, and a method for detecting a load compensation amount of an elevator in which the initial starting torque of the drive motor is controlled according to passenger of the elevator car, including the steps of: setting load compensation amounts for at least two positions of an elevator car between the lowermost floor and the uppermost floor where the elevator is moved; obtaining a non-linear relational function expression between the position of the elevator car and the load compensation amount on the basis of the data for the set compensation amount, of which the relational function expression is divided into one or more intervals, for which respective polynomials are derived; and detecting a load compensation amount for the position of the elevator car on the basis of the relational function expression.

11 Claims, 8 Drawing Sheets

| |
|---|
| ⋮ |
| Xa |
| Ya |
| Xb |
| Yb |
| $a_1$ |
| $a_2$ |
| ⋮ |
| R |
| S |
| T |
| ⋮ |

NON-LINEAR LOAD DETECTION AND COMPENSATION FOR ELEVATORS

BACKGROUND OF THE INVENTION

1. Field of the Invention

The present invention relates to an apparatus for detecting a load amount and a load compensation amount of an elevator and method thereof, and more particularly, to an apparatus for detecting a load amount and a load compensation amount which is capable of detecting a weight of a passengers in an elevator even through a load detector for detecting the weight of the passengers in the elevator does not have linear characteristics in proportion to the weight of the passengers, capable of detecting an accurate load compensation amount by controlling differently an initial starting torque of a drive motor depending on floors where an elevator car is positioned to thereby improve a ride comfort when the elevator car starts moving, and capable of improving a reliability for a basic data of an operation such as a situation analysis for the use of elevator such as detection of a full capacity of the passengers, computation of the number of the passengers in getting in and getting off by floors, to thereby improve an efficiency in service of the elevator and method thereof.

2. Description of the Background Art

FIG. 1 is schematic block diagram of an apparatus for detecting a load amount and a load compensation amount of an elevator in accordance with a conventional art.

As shown in the drawing, at the lower portion of the inside of the elevator car 1, there are provided a rubber isolator 2 of which displacement amount is varied according to weight of the passengers on the elevator, a load detector 3 for converting the displacement amount of the rubber isolator to an electric signal, and a position detector 9 for detecting a position of the elevator car 1.

An output signal of the load detector 3 is applied to the converter 4, and the converter 4 converts the analog signal of the load detector 3 to a digital signal and transmits it to the input unit 5.

The digital signal transmitted to the input unit 5 is transmitted to the CPU 8 where if there is no passenger in the elevator car 1, its percent load value for the passengers becomes 0% according to a load amount detecting operation expression and stored in the memory unit 6, while if there is passengers as much as the rated load amount, the percent load value is operated as 100% and stored in a specific region of the memory unit.

The percent load value for the passengers is read from the memory unit 6 as necessary, converted to a basic data for the operation control data and the torque signal of the drive motor by a predetermined operation expression, and then outputted through the output unit 7.

The operation of the apparatus for detecting the load amount and load compensation amount of an elevator in, accordance with the conventional art constructed as described above will now be explained.

First, an output data of the load detector 3 is set in a no-load state that load of the elevator car 1 is '0' and the current load amount of the passengers of the elevator is detected by using the output data of the load detector 3 in the full load state that the load of the elevator car 1 is a rated load on the assumption that the load detector 3 has a linear output characteristics for all load states.

FIG. 2 is an operation graph for detecting the percent load of the passengers of the elevator over the output data of the load detector 3, in which Y axis indicates a percent load of the elevator passengers, and X axis indicates the output data of the load detector 3. Here, Ya shows the case where there is no passengers in the elevator car 1, that is, a no-load state having 0 percent load value, and Xa indicates the output data of the load detector 3 in a no-load state. Yb shows the case where there is passengers in the elevator car 1 as much as the rated load amount, that is, a full load state having 100% load value. Xb indicates an output data of the load detector 3 in the full load state.

The point Q1 corresponding to the value in the no-load state, and the point A5 corresponding to the value in the full load state are set when the elevator is installed, and if an error occurs between the actual load amount and the load amount according to the load amount operation after the elevator is installed, they are re-set.

Detection of the load amount for the current elevator is computed by a linear function f(x) over the line linking the point Q1 and the point Q2. When the function f(x) is expressed by alx+a2, a slope a1 of f(x) has the value of (Yb−Ya)/(Xb−Xa), and a2 can be computed by using one value of the point Q1 and the point Q2. Thusly computed values are stored in the memory unit of FIG. 1 in the form as shown in FIG. 3.

FIG. 4 is a flow chart of a process of detecting a load amount according to the above method, which will now be described.

First, a detect value of the load detector is read through the input unit (stage: 410). In this respect, for example, the detect value is assumed as Xc. Thereafter, the coefficients a1 and a2 of f(x) of the memory unit are read (stage: 420). Assuming that a percent load value desired to be obtained is Yc, this value is computed as a1x+a2 (stage: 430). The computation result is transferred to the output unit (stage: 440).

The detection of the load amount will now be described with reference to FIG. 2.

In case that the value detected by the load detector is Xc, in order to obtain a percent load value, a vertical line is drawn from Xc to the straight line linking Q1 and Q2, which is met at the point Q3, from which a straight line is drawn to Y axis. Here, the point meeting with the Y axis, that is, Yc is the percent load value over the load state inside of the current elevator car.

Meanwhile, in controlling an initial starting torque of the drive motor so as to keep favorably the ride comfort when the elevator starts, a bias amount is respectively set according to the position region and the operation direction of the elevator car 1 in the no-load state, which is critical factor for the initial starting torque.

Operation expression of the initial starting torque of the driver motor is as follows:

$$\text{Initial starting torque}=(\text{weight of the passengers} \times \text{starting compensation gain})+\text{bias amount} \quad (1)$$

In the above equation, the starting compensation gain refers to a compensation amount for the initial starting torque in a full load state, and the bias amount refers to a compensation amount for the initial starting torque in the no-load state, which has different values according to the operation direction and the position region of the elevator car 1

When the elevator car moves upward in a state that the initial starting torque is small for the passengers of the elevator car, the elevator car 1 starts moving upward with a downward slip, while when the elevator car 1 moves upward in a state that the initial starting torque is large for the passenger of the elevator car, a starting shock occurs so that the elevator car 1 moves at a pre-set speed after bouncing in the upward direction, which spoils the ride comfort.

FIG. 5 shows an up-bias amount of each position of the elevator car 1 when it moves in the upward direction, of which X axis indicates a bias amount and Y axis indicates a position of the elevator car 1. Here, the point R indicates an upbias amount set at the lowermost floor is the point R, the upbias amount set at the middle floor is the point S, and the upbias amount set at the uppermost floor is the point 'T'.

The upbias amount by floors of the elevator car 1 is applied in a manner that the distance from the lowermost floor to the uppermost floor is divided into three parts of a low zone, a middle zone and a high zone so that if the elevator car 1 is positioned in the low zone, the upbias amount corresponding to the point R is applied thereto, if the elevator car 1 is positioned in the middle zone, the upbias amount corresponding to the point S is applied thereto, and if the elevator car 1 is positioned in the high zone, the upbias corresponding to the point T is applied thereto.

FIG. 6 is a flow chart of the upward operation in case that the bias amount by positions of the elevator is applied.

First, a value outputted from the elevator position detector is inputted through the input unit at stage 601.

And, it is judged whether the current operation direction of the elevator car is an upward direction. Here, it is assumed that the operation direction is the upward direction at stage 620.

Thereafter, it is judged whether the current position of the elevator car is in the high zone or in the middle zone at stages 630 and 640.

If it is judged that it is in the high zone, 'T' value is read out from the memory unit 6, while if it is judged that it is in the middle zone, 'S' value is read out from the memory unit at stages 660 and 670.

And then, the value as read is outputted to the output unit at stage 680.

If the current position of the elevator car does not correspond to the two zones, it is judged that it is positioned in the low zone, according to which a bias amount R is read out form the memory unit at stage 650 and then outputted to the output unit at stage 680.

A downbias amount in the downward direction is applied in the same manner that bias amounts by position zones and operation directions of the elevator car 1 are set when the elevator is initially installed. In this respect, if a stroke of the elevator is great, the bias amount by position zones is divided into three intervals, for which a bias amount is set and applied.

However, the conventional art has problems in that an error is contained in detecting the load amount due to the non-linearity of the output data of the load detector according to the load amount increase, which does not provided an accurate load amount. And, since the bias amount of the floor where the elevator car is actually positioned is not accurately detected in the operation process of the initial starting torque when the elevator car starts moving, so that an error occurs, making it impossible to compute an accurate starting torque

SUMMARY OF THE INVENTION

Therefore, an object of the present invention is to provide an apparatus and method for detecting a load amount which is capable of accurately detecting the weight of the passengers even though an output of an elevator has a nonlinear characteristics according to the weight of the passengers.

Another object of the present invention is to provide an apparatus and method for detecting a load compensation amount of an elevator in which a bias amount according to the floor where an elevator car is actually positioned is accurately detected to thereby control an initial starting torque of a drive motor.

To achieve these and other advantages and in accordance with the purposed of the present invention, as embodied and broadly described herein, there is provided an apparatus for detecting a load amount of an elevator which detects the weight of passengers of an elevator car in an elevator system including: a load detector for detecting the weight of the passengers of an elevator and outputting it as an electric signal; an input unit for inputting the signal detected by the load detector to a CPU; the CPU for receiving the signal from the input unit, obtaining at least two non-linear relational function expressions between the output data of the load detector and the load amount, to store them, and judging and selecting a load amount on the basis of the at least two relation function expressions; a memory unit for storing the at least two non-linear relational function expressions as obtained by the CPU; and an output unit for externally outputting the load amount detected by the CPU.

Regarding the apparatus for detecting a load amount of an elevator, the non-linear relation function expression is a polynomial.

Regarding the apparatus for detecting a load amount of an elevator, the CPU applies respective polynomial for a load over a reference value and a load below the reference value on the basis of 50% of a rated load.

To achieve the above objects, there is also provided a method for detecting a load amount of an elevator which detects the weight of the passengers of an elevator car in an elevator system including the steps of: setting an output data of a load detector for at least two load amounts between an no-load and full load; obtaining a non-linear relational function expression between the output data of the load detector and the load amounts on the basis of the set data; selecting one of the at least two functional expressions on the basis of the relational function expressions, and detecting and outputting a load amount for the passengers of the elevator car.

Regarding the method for detecting the load amount of an elevator, the non-linear relational function expression is divided into one or more intervals, for which respective polynomials are derived, according to which load amounts for the passengers of the elevator car are detected.

Regarding the method for detecting a load amount of an elevator, two non-linear relational function expressions are derived on the basis of 50% of a rated load, and a corresponding relation function expression is applied to according to the size of the inputted load, to thereby detect a load amount.

Regarding the method for detecting a load amount of an elevator, the non-linear relational function expression of each interval is obtained by an interpolation polynomial method.

In order to achieve the above objects, there is also provided an apparatus for detecting a load compensation amount of an elevator in which an initial starting torque of a drive motor is controlled according to passengers of an elevator car, including: an elevator position detector for detecting a current position of an elevator car; a CPU for setting load amounts for at least two positions of the elevator car between the lowermost floor and the uppermost floor where the elevator is moved, obtaining a non-linear relational function expression between the position of the elevator car and the load compensation amount on the basis of the data for the compensation amount as set, to store it in a memory unit, operating the load compensation amount for the position of the elevator car on the basis of the relational function expression when the position signal of the elevator car is inputted from the input unit, to output the same to the output unit; a memory unit for storing the non-linear polynomial relational function expression obtained by the CPU; and an output unit for outputting the load compensation amount for the position of the elevator car detected by the CPU.

Regarding the apparatus for detecting a load compensation amount of an elevator, the non-linear relational function expression is divided into one or more intervals, for which respective polynomials are derived for each intervals, by which the load compensation amount is detected for the position of the elevator.

In order to achieve the above objects, there is also provided a method for detecting a load compensation amount of an elevator in which the initial starting torque of the drive motor is controlled according to passenger of the elevator car, including the steps of: setting load compensation amounts for at least two positions of an elevator car between the lowermost floor and the uppermost floor where the elevator is moved; obtaining a non-linear relational function expression between the position of the elevator car and the load compensation amount on the basis of the data for the set compensation amount, of which the relational function expression is divided into one or more intervals, for which respective polynomials are derived; and detecting a load compensation amount for the position of the elevator car on the basis of the relational function expression.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
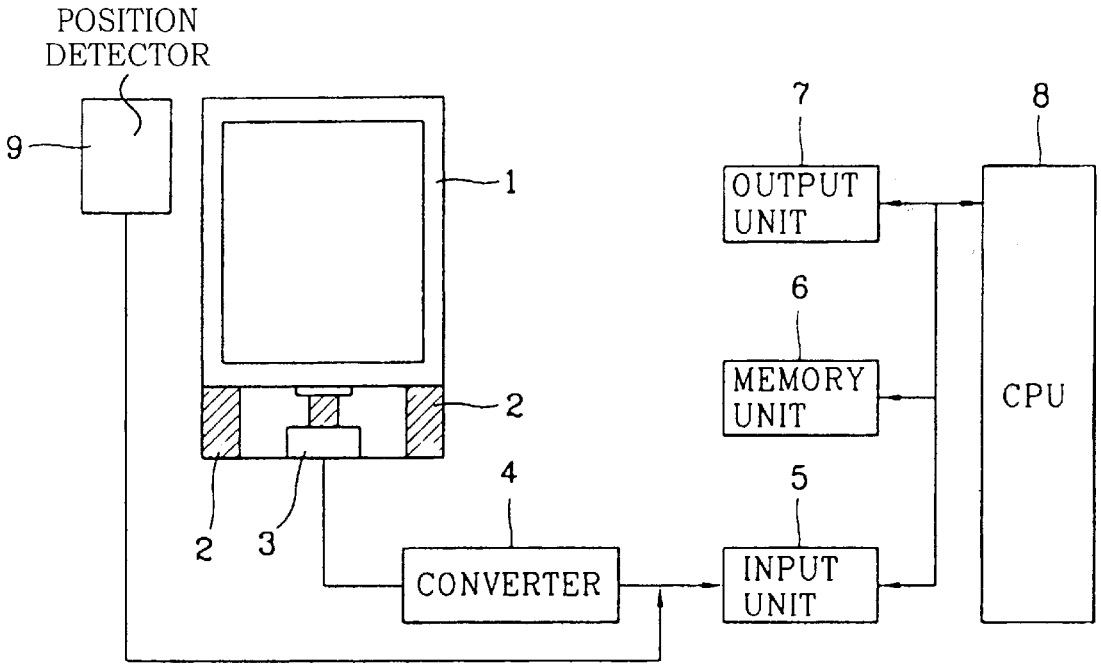
FIG. 1 CONVENTIONAL ART
FIG. 1 is a schematic block diagram of an apparatus for detecting a load amount and a load compensation amount of an elevator in accordance with a conventional art.
Figure 2:
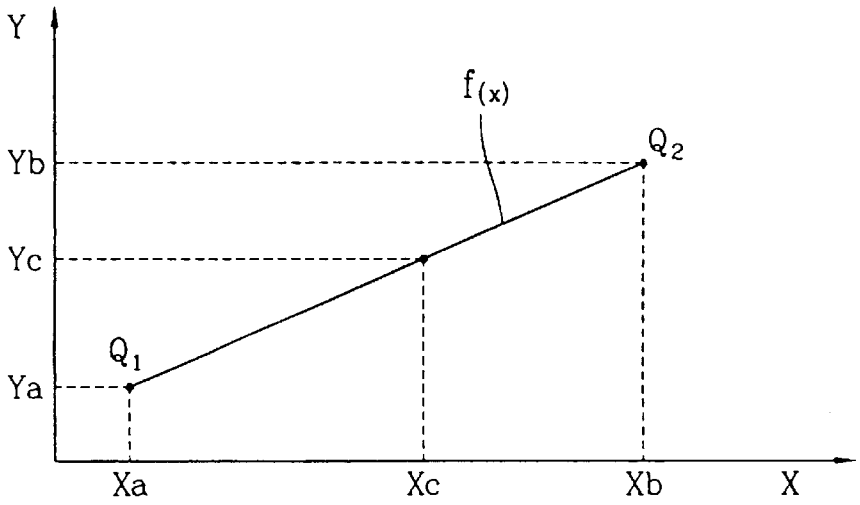
FIG. 2 CONVENTIONAL ART
FIG. 2 is an operational graph showing detection of a percent load for passengers in the elevator car over the output data of the load detector in accordance with the conventional art.
Figures 3, 4:
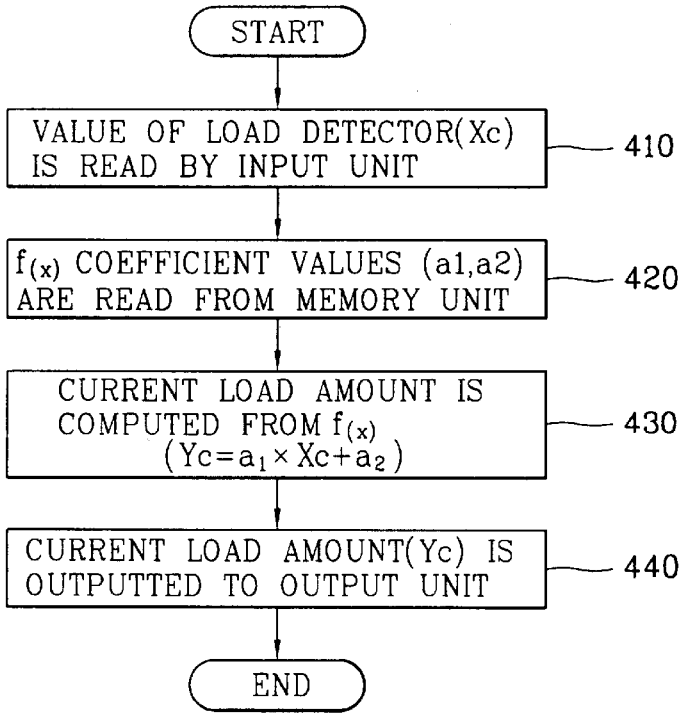
FIG. 3 CONVENTIONAL ART
FIG. 4 CONVENTIONAL ART
FIG. 3 shows a structure of a memory unit in accordance with the conventional art.
FIG. 4 is a flow chart of process of detecting a load amount of the elevator car in accordance with the conventional art.
Figure 5:
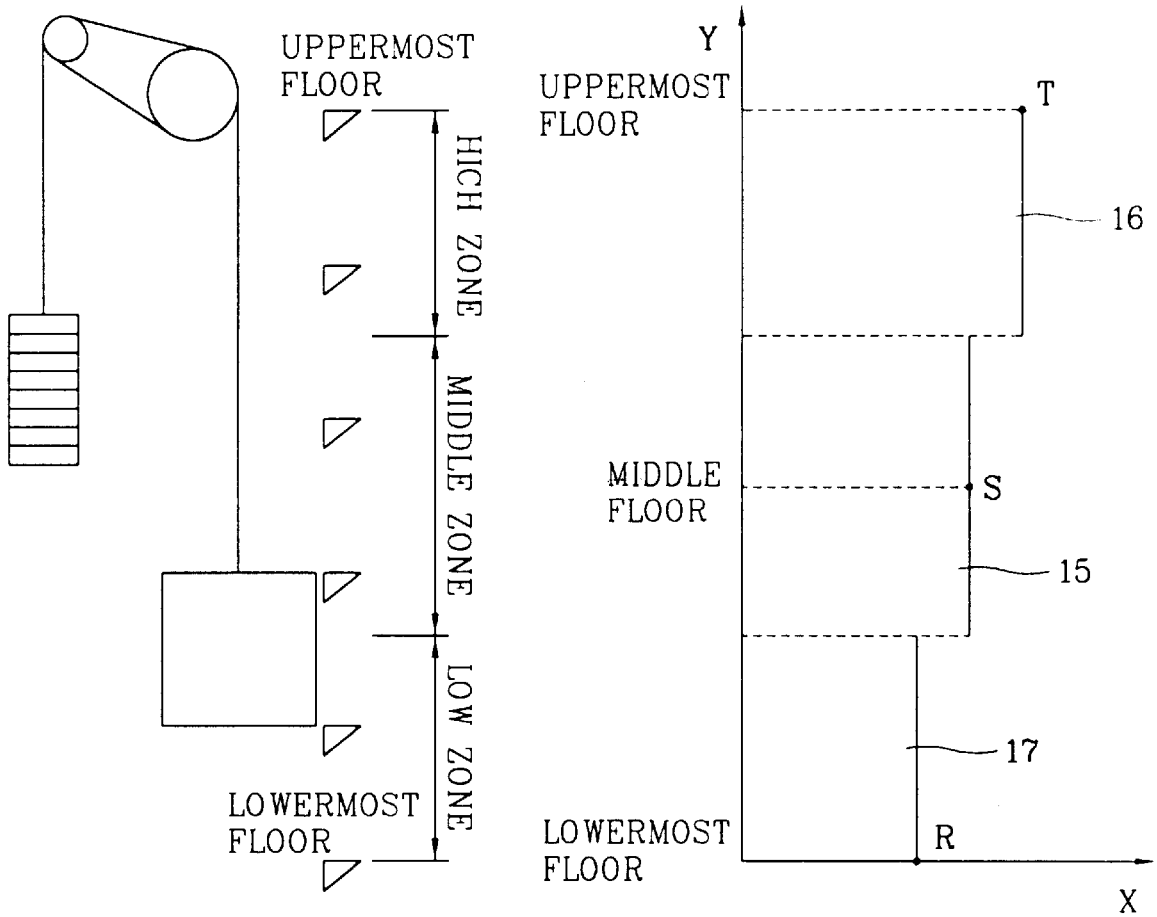
FIG. 5 CONVENTIONAL ART
FIG. 5 illustrates an upbias amount by positions of the elevator car in the upward direction in accordance with the conventional art.
Figure 6:
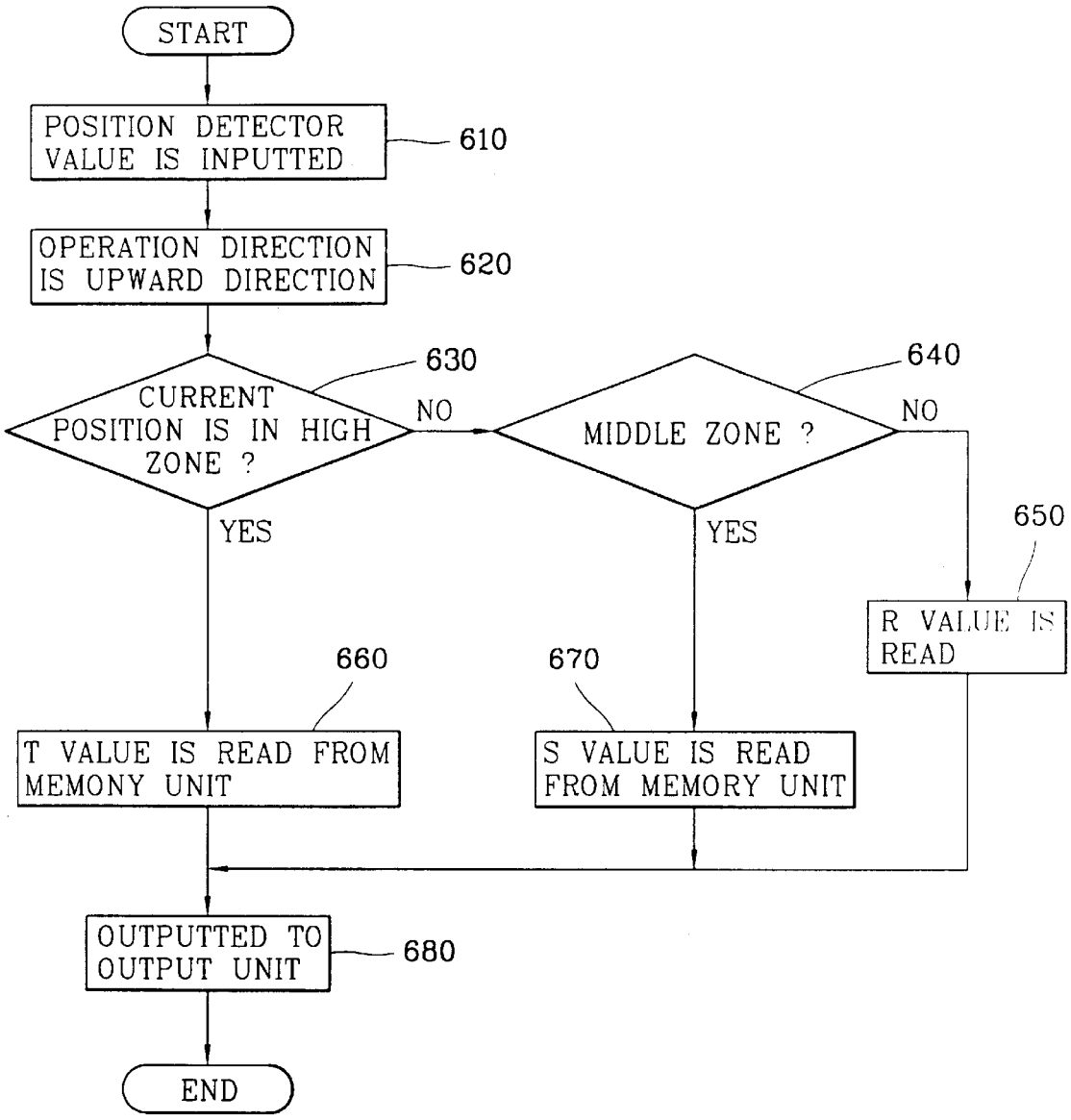
FIG. 6 CONVENTIONAL ART
FIG. 6 is a flow chart of an upward operation of the elevator car in case where the bias amount by positions of the elevator car is applied thereto.
Figure 7:
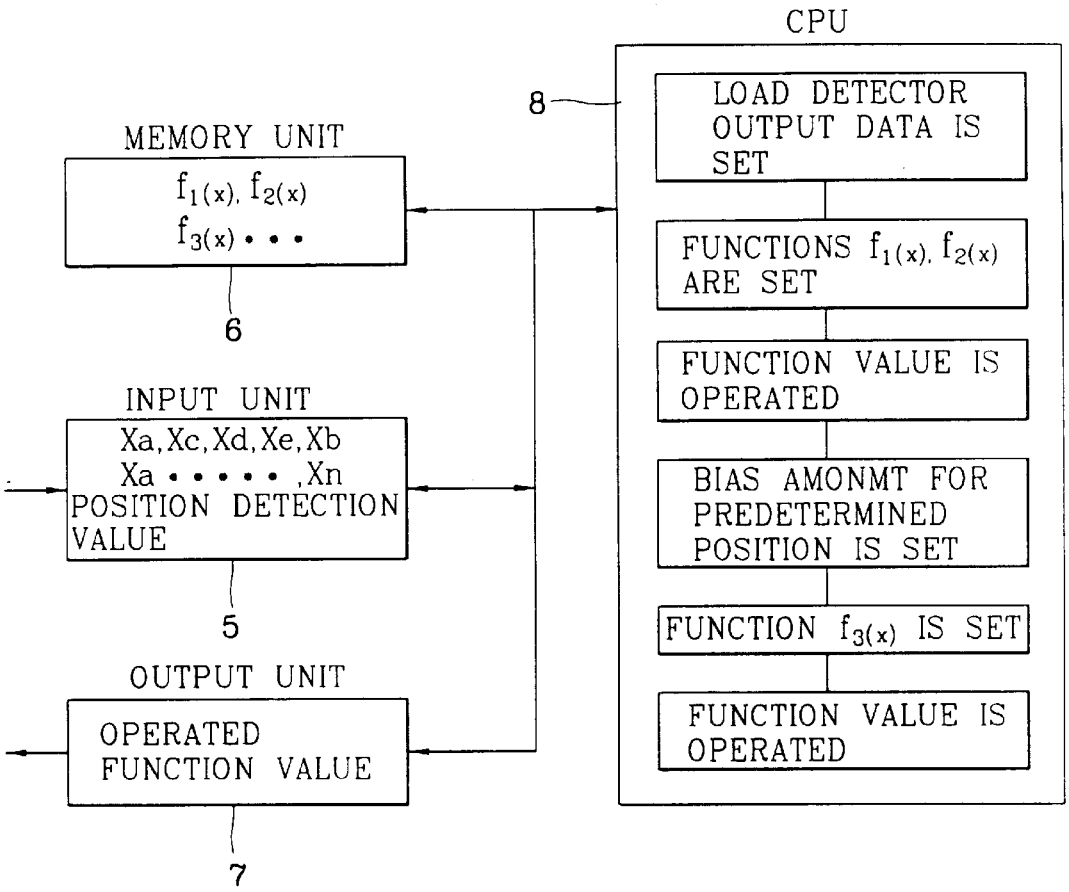
FIG. 7 is a schematic block diagram showing a construction of an apparatus for detecting a load amount and a load compensation amount in accordance with the present invention.

FIG. 7 shows a construction of the apparatus for detecting a load amount and a load amount compensation amount of an elevator in accordance with the present invention, which is mostly the same as that of the conventional art as shown in FIG. 1, only except that the CPU 8 divides the load detection interval into two parts for obtaining the non-linear characteristics so as to detect an accurate load amount and compensate the load even though the load detector 3 has non-linear characteristics.

For this purpose, the CPU 8 sets the two parts by receiving the output data of the load detector 3 in no-load state that the load of the elevator car 1 is '0' and an output data of the load detector 3 in a full load stage that the load of the elevator car 1 is a rated load.

Thereafter, output data of the load detector 3 is respectively set by 20% 50% and 80% of the rated load of the load in the elevator car 1, so that a non-linear quadratic function expression f1(x) is obtained linking the three points set in the no-load state, in the 20% load state of the rated load and in the 50% load state of the rated load, and a non-linear quadratic function expression f2(x) is obtained linking the three points set in a 50% load state of the rated load, a 80% load state of the rated load and in a full load state.

Subsequently, a current load amount of passengers of the elevator car over the output data of the load detector 3 is operated and detected by the two function expressions.

Figure 8:
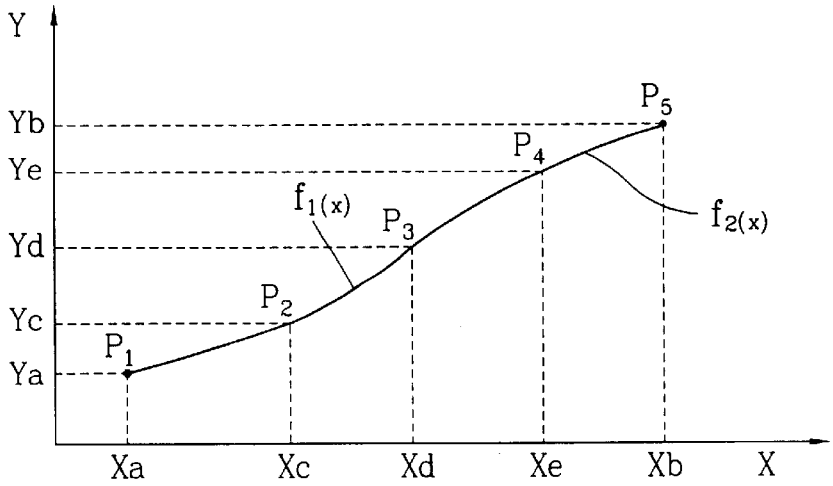
FIG. 8 is a graph showing detection of a percent load of passengers of an elevator car over the output data of an elevator load detector in accordance with the present invention.

FIG. 8 is an operation graph of the detection of a percent load of elevator passengers over the output data of the load detector 3, of which Y axis indicates a percent load of the elevator passengers, X axis indicates the output data of the load detector 3, Ya has a 0% load value in a no-load state when there is no passengers in the elevator car 1, and the point P1 corresponds to the output data Xa of the load detector 3 in the no-load state Ya.

Xb has a 100% load value, representing a full load state, when there is passengers in the elevator car 1 as much as the rated load, and the point P5 corresponds to the output data Xb of the load detector 3 in the full load state Yb.

Yc is a load amount that the passengers in the elevator car 1 correspond to 20% of the rated load amount, and the point P2 corresponds to the output data Xc of the load detector 3 in the load amount state Yc corresponding to 20% of the rated load amount.

Yd refers to a load amount that the passengers in the elevator car 1 corresponds to 50% of the rated load amount, and the point P3 corresponding to the output data Xd of the load detector 3 in. the load amount state Yd corresponding to 50% of the rated load amount.

Ye refers to a load amount that the passengers in the elevator car 1 corresponds to 80% of the rated load amount, and the point P4 corresponding to the output data Xe of the load detector 3 in the load amount state Ye corresponding to 80% of the rated load amount The points P1~P5 are set when the elevator is installed, which can be reset when an error occurs between the actual load amount and the load amount according to the arithmetic operation of the load amount.

The current load amount for the passengers of the elevator car is determined by the quadratic function expression f1(x) corresponding to the points P1~P3 and the quadratic function operation f2(x) corresponding to the points P3~P5. If the output data of the load detector 3 is between X1 and Xb, the load amount for the passengers is determined by the quadratic function expression f1(x). If the output data of the load detector 3 is greater than Xd and smaller than Xb, the load amount for the passengers is determined by the quadratic function expression f2(x).

Since the operation expression f1(x) and f2(x) for detecting the load amount by each interval is a quadratic function expression, an accurate load amount can be detected even though the load detector 3 has a non-linear characteristics. The operation expression f1(x) and f2(x) are obtained by the interpolation polynomial method as follows:

f1(x) of the point P1 (Xa, Ya), the point P2 (Xc, Yc) and the point P3 (Xd, Yd) is as follows:

$$f1(x)=Ya+(X-Xa)\ f[Xa, Xc]+(X-Xa)(X-Xc)\ f[Xa, Xc, Xd] \quad (2)$$

In the expression (1), $$f[Xa, Xc, Xd]=(f[Xc, Xd]-f[Xa, Xc])/(Xd, Xa) \quad (3)$$

In the expressions (2) and (3), f[Xc, Xd]=(Yd-Yc)/(Xd-Xc).

And, f2(x) can be obtained in the same manner.

The coefficients of the quadratic function expressions f1(x) and f2(x) obtained by the above manner are stored in the memory unit of FIG. 7.

Figure 9:
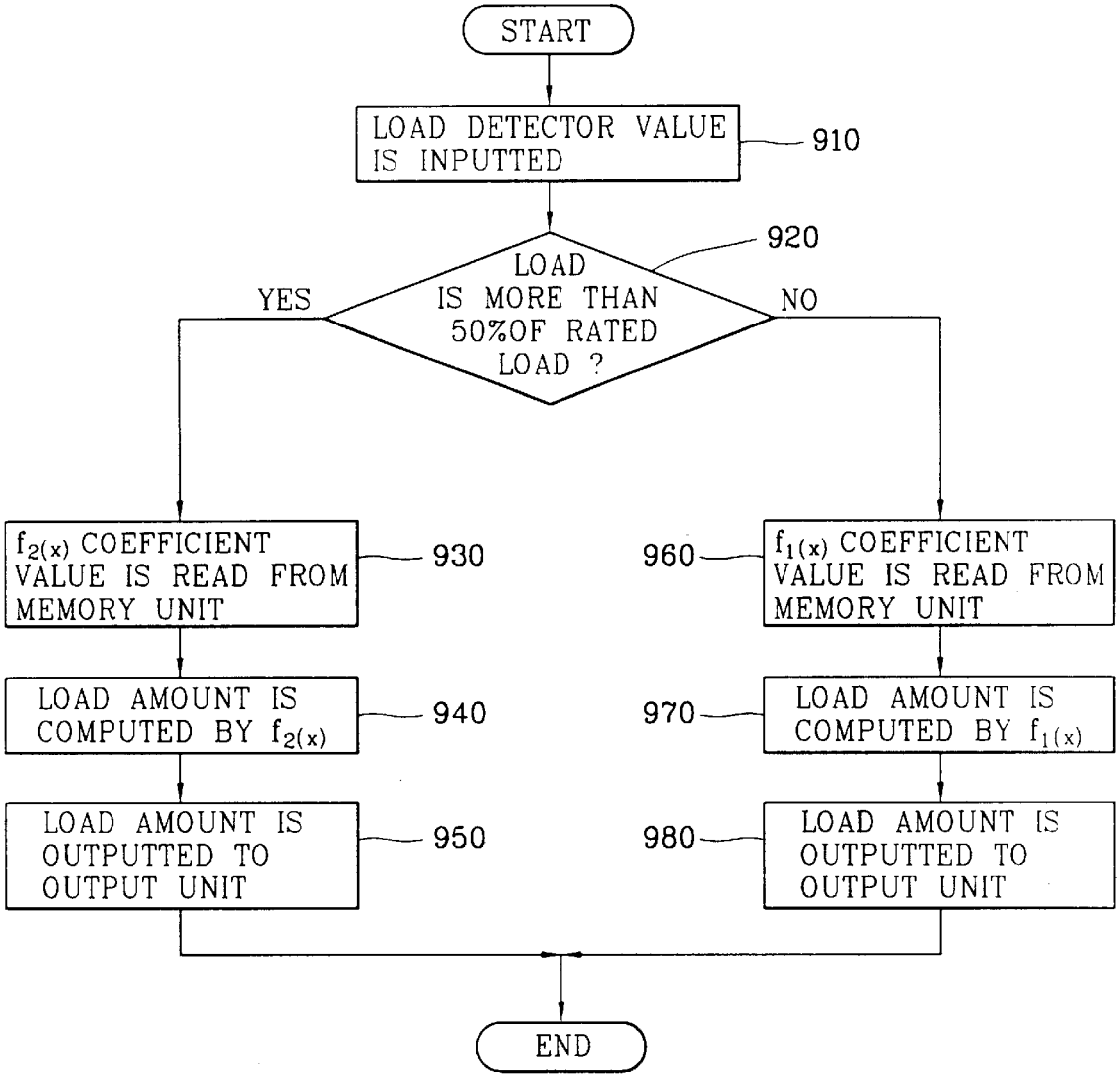
FIG. 9 is a flow chart of a process of detecting a load amount by dividing the load amount into two on the basis of 50% of a rated load in accordance with the present invention.

FIG. 9 is a flow chart of a process of detecting a load amount by dividing the load amount into two on the basis of 50% of a rated load in accordance with the present invention.

First, output value of the load detector is inputted through the input unit, and it is judged whether the load is more than 50% of the rated load at stages 910 and 920.

Upon judgement, if the load is below 50% of the rated load, the f1(x) coefficient values stored in the memory unit are read out and a load amount of the f1(x) function is computed at stages 960 and 970. And then, the computed load amount is outputted to the output unit at stage 980.

Meanwhile, upon such judgement, if the load is more than 50%, the f2(x) coefficient values stored in the memory unit are read out and its load amount is computed at stages 930 and 940. And then, the computed load amount is outputted to the output unit at stage 950.

The construction of the apparatus for detecting a load compensation amount of an elevator and the operation expression for obtaining an initial starting torque of a driver motor of the elevator are mostly similar to those in the conventional art but the characteristics related to FIG. 7.

As shown in FIG. 7, referring to the bias amount for the position of the elevator car 1, only the bias amount is set at the lowermost floor, the middle floor and the uppermost floor regardless of the stroke distance of the elevator car and the non-linear quadratic function expression is obtained linking the three points as set, based on which the bias amount for the floor where the elevator car 1 is position is detected.

Since the operation function expression for the bias amount for the position of the elevator car 1 is a quadratic function expression, various bias amounts can be detected to cope with no matter where the elevator car 1 is positioned, so that a suitable bias amount can be provided according to the situation.

Figure 10:
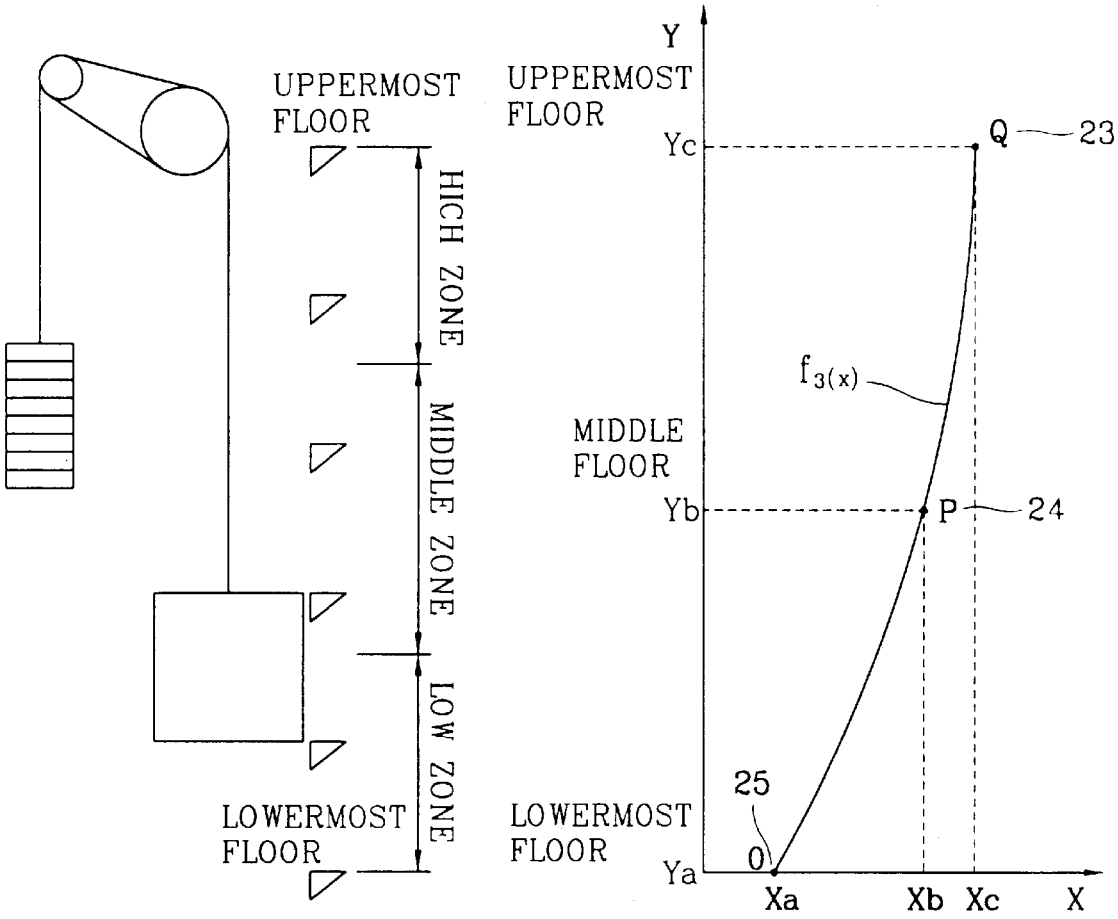
FIG. 10 illustrates a non-linear characteristics curve over the upbias amount by positions of the elevator car when the elevator car moves in the upward direction in accordance with the present invention.

FIG. 10 illustrates an upbias amount by positions of the elevator car when it is moved in the upward direction, in which X axis indicates the bias amount, Y axis indicates the position of the elevator car 1, the upbias amount set at the lowermost floor is the point 'O', the upbias amount set at the middle floor is the point 'P', and the upbias amount set at the uppermost floor is the point 'Q'.

The upbias amount by current positions of the elevator car 1 is determined by a quadratic function expression f3(x) corresponding to the points 0, P and Q, which is obtained as follows:

The operation expression f3(x) of the point 0 (Xa, Ya), the point P (Xb, Yb) and the point Q (Xc, Yc)=Yb+(X−Xa) f[Xa, Xb]+(X−Xa)(X−Xb) f[Xa, Xb, Xc](4).

In the equation (4), $$f[Xa, Xb, Xc]=(f[Xb, Xc]-f[Xa, Xb])/(Xc-Xa) \quad (5)$$

Thusly obtained non-linear characteristics curves are used for the load detection of the elevator and the load compensation.

Figure 11:
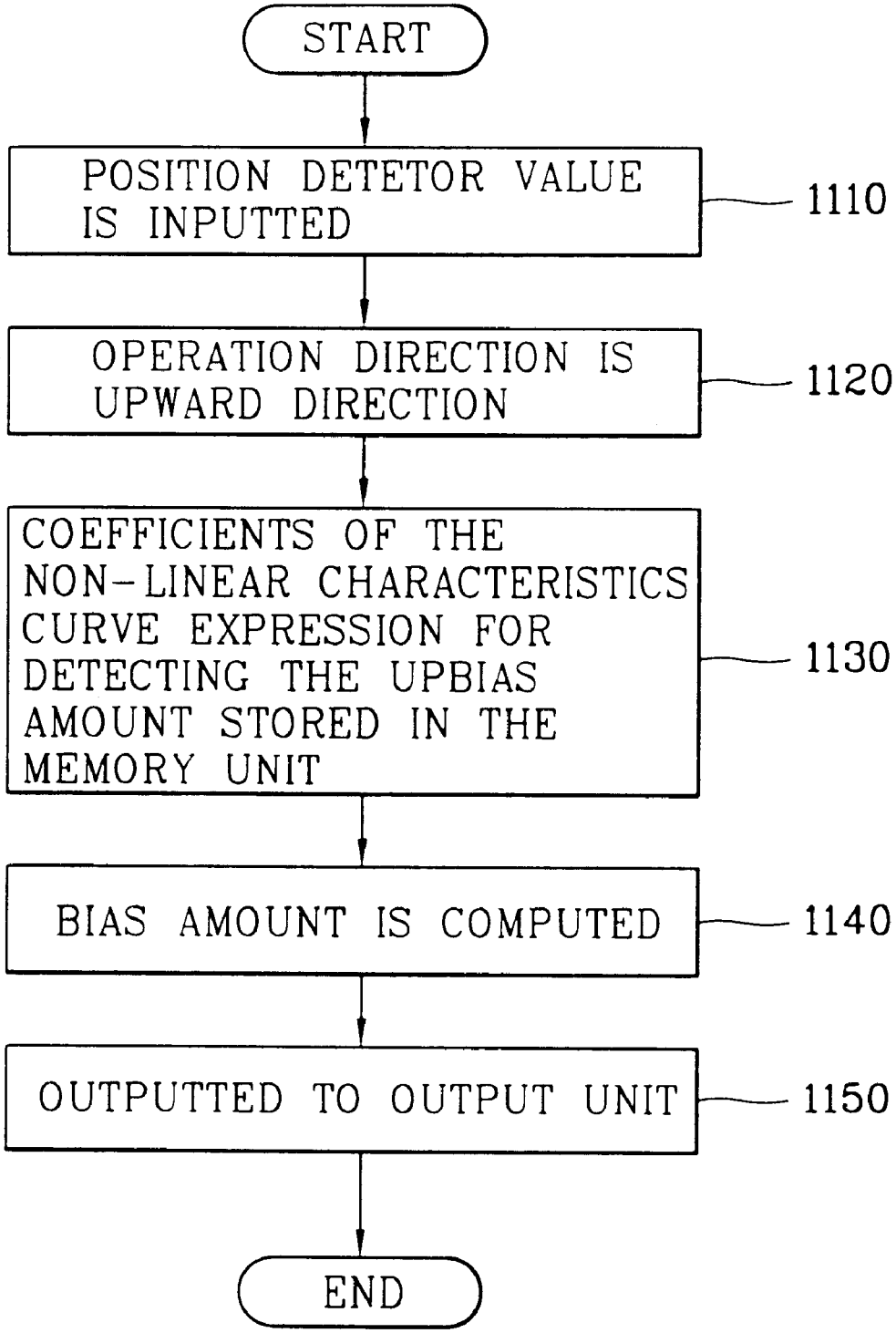
FIG. 11 is a flow chart of a processor of detecting the upbias amount of an elevator by using the non-linear characteristics curve in accordance with the present invention.

FIG. 11 is a flow chart of a process of the method of using the non-linear characteristics curve for the load detection of the elevator and the load compensation.

First, an output value of the elevator position detector is inputted, and it is judged whether the current operation direction is upward direction. Here, it is assumed that the operation direction is the upward direction at stages 1110 and 1120.

And, the coefficients of the non-linear characteristics curve expression for detecting the upbias amount stored in the memory unit is read at stage 1130.

Thereafter, a bias amount for the current position of the elevator car is computed by using the non-linear characteristics curve and the current position of the elevator car, and the computed result is outputted to the output unit at stages 1140 and 1150.

As so far described, according to the apparatus and method for detecting a load amount and a load compensation amount of the elevator of the present invention, when the elevator car starts moving, the load amount for the passengers in the elevator car and the load compensation amount operated as the bias amount for the floor where the elevator car is positioned are applied to the initial starting torque of the motor, so that the slip phenomenon of the elevator car occurring in its initial start can be prevented, thereby improving the ride comfort for the elevator car.

Also, in case that the stroke distance of the elevator car is great when the elevator is installed, since the entire floors are divided into several intervals and characteristics curves for each interval are obtained, the accurate bias amount for the floor where the elevator car is positioned can be detected. Accordingly, there is provided a convenience for installment and adjustment of the elevator, and a service efficiency the control of the elevator can be highly improved.

As the present invention may be embodied in several forms without departing from the spirit or essential characteristics, thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. An apparatus for detecting a load amount of an elevator which detects the weight of passengers of an elevator car in an elevator system, comprising:

a load detector for detecting the weight of the passengers of an elevator and outputting it as an electric signal;

an input unit for inputting the signal detected by the load detector to a CPU;

a CPU for receiving the signal from the input unit, obtaining at least two non-linear relational function expressions between the output data of the load detector and the load amount, to store them, and judging and selecting a load amount on the basis of the at least two relation function expressions;

a memory unit for storing the at least two non-linear relational function expressions as obtained by the CPU; and an output unit for externally outputting the load amount detected by the CPU.

2. The apparatus according to claim 1, wherein the non-linear relation function expression is a polynomial.

3. The apparatus according to claim 1, wherein the CPU applies respective polynomial for a load over a reference value and a load below the reference value on the basis of 50% of a rated load.

4. A method for detecting a load amount of an elevator which detects the weight of the passengers of an elevator car in an elevator system, comprising the steps of:

setting an output data of a load detector for at least two load amounts between an no-load and full load;

obtaining a non-linear relational function expression between the output data of the load detector and the load amounts on the basis of the set data;

electing one of the at least two functional expressions on the basis of the relational function expressions, and detecting and outputting a load amount for the passengers of the elevator car.

5. The method according to claim 4, wherein the non-linear relational function expression is divided into one or more intervals, for which respective polynomials are derived, according to which load amounts for the passengers of the elevator car are detected.

6. The method according to claim 4, wherein two non-linear relational function expressions are derived on the basis of 50% of a rated load, and a corresponding relation function expression is applied to according to the size of the inputted load, to thereby detect a load amount.

7. The method according to claim 5, wherein the non-linear relational function expression of each interval is obtained by an interpolation polynomial method.

8. An apparatus for detecting a load compensation amount of an elevator in which an initial starting torque of a drive motor is controlled according to passengers of an elevator car, comprising:

an elevator position detector for detecting a current position of an elevator car;

a CPU for setting load amounts for at least two positions of the elevator car between the lowermost floor and the uppermost floor where the elevator is moved, obtaining a non-linear relational function expression between the position of the elevator car and the load compensation amount on the basis of the data for the compensation amount as set, to store it in a memory unit, operating the load compensation amount for the position of the elevator car on the basis of the relational function expression when the position signal of the elevator car is inputted from the input unit, to output the same to the output unit;

a memory unit for storing the non-linear polynomial relational function expression obtained by the CPU; and an output unit for outputting the load compensation amount for the position of the elevator car detected by the CPU.

9. The apparatus according to claim 8, wherein the non-linear relational function expression is divided into one or more intervals, for which respective polynomials are derived for each intervals, by which the load compensation amount is detected for the position of the elevator.

10. A method for detecting a load compensation amount of an elevator in which the initial starting torque of the drive motor is controlled according to passengers of the elevator car, comprising the steps of:

setting load compensation amounts for at least two positions of an elevator car between the lowermost floor and the uppermost floor where the elevator is moved;

obtaining a non-linear relational function expression between the position of the elevator car and the load compensation amount on the basis of the data for the set compensation amount, of which the relational function expression is divided into one or more intervals, for which respective polynomials are derived; and detecting a load compensation amount for the position of the elevator car on the basis of the relational function expression.

11. The method according to claim 6, wherein the non-linear relational function expression of each interval is obtained by an interpolation polynominal method.

* * * * *

UNITED STATES PATENT AND TRADEMARK OFFICE

CERTIFICATE OF CORRECTION

PATENT NO. : 6,286,628 B1
DATED : September 11, 2001
INVENTOR(S) : Soo-Cheol Lee It is certified that error appears in the above-identified patent and that said Letters Patent is hereby corrected as shown below:

Title page,
Item [30], Foreign Application Priority Data", please correct the priority application date from "Jan. 28, 1999" to -- Jan. 29, 1999 --.

Signed and Sealed this

Thirtieth Day of July, 2002

*Attest:*

*Attesting Officer*

JAMES E. ROGAN
*Director of the United States Patent and Trademark Office*